United States Patent [19]

York et al.

[11] Patent Number: 4,969,305

[45] Date of Patent: Nov. 13, 1990

[54] INDICIA APPLYING APPARATUS

[75] Inventors: George York, Palm Harbor; John E. Taylor, St. Petersburg, both of Fla.

[73] Assignee: Philip Morris Incorporated, New York, N.Y.

[21] Appl. No.: 401,068

[22] Filed: Aug. 31, 1989

[51] Int. Cl.[5] ..... B65B 61/02; B65B 61/26

[52] U.S. Cl. ..... 53/137; 156/542; 156/DIG. 2

[58] Field of Search ..... 53/131, 137, 381 R, 53/382, 411, 415; 156/235, 240, 541, DIG. 2, 540, 542

[56] References Cited

U.S. PATENT DOCUMENTS

| | | | |
|---|---|---|---|
| 2,916,859 | 12/1959 | Klein | 53/411 X |
| 3,392,501 | 7/1968 | Gilchrist | 53/411 |
| 3,524,295 | 8/1970 | Spaulding | 53/415 |
| 3,777,445 | 12/1973 | Anderson | 53/411 X |
| 3,944,455 | 3/1976 | French | 156/361 |
| 4,263,766 | 4/1981 | Baker et al. | 53/382 X |
| 4,285,752 | 8/1981 | Higgins | 156/522 X |
| 4,462,851 | 7/1984 | Colgate | 53/137 X |
| 4,586,312 | 5/1986 | Limousin | 53/415 X |

*Primary Examiner*—Robert L. Spruill
*Assistant Examiner*—Beth Bianca
*Attorney, Agent, or Firm*—Robert R. Jackson

[57] ABSTRACT

Indicia such as tax stamps are applied to objects such as cigarette packs by driving a heated ram against the back of an indicia supply tape to cause the indicium to transfer from the tape to the object. If the object is contained in outer packaging such as cigarette carton packaging, that outer packaging is opened prior to applying the indicia to the objects. Then the outer packaging is reclosed. The indicia supply tapes are contained in cartridges which are easily removed for reloading and storage in a secure place. The cartridges are mounted on heads in the machine which are movable to facilitate applying indicia with various spacings and in various arrangements.

7 Claims, 7 Drawing Sheets

FIG. 5
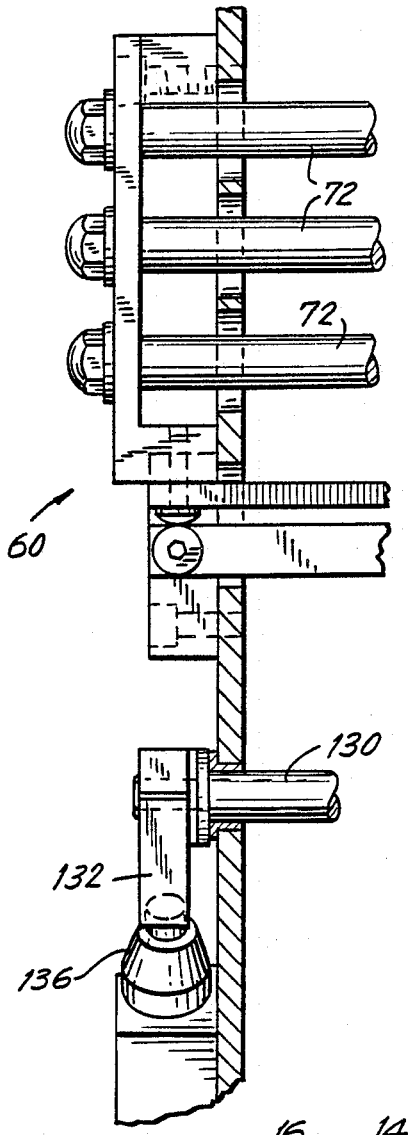
FIG. 6
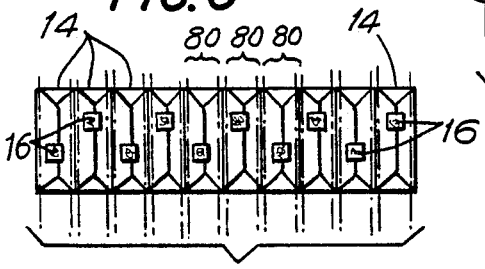
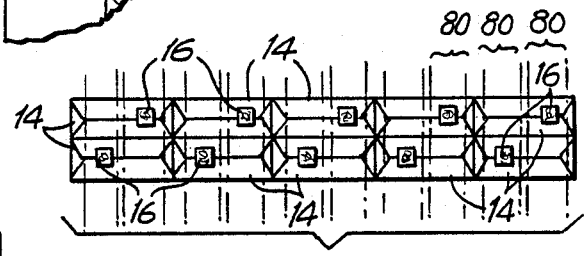
FIG. 7

INDICIA APPLYING APPARATUS

BACKGROUND OF THE INVENTION

This invention relates to methods and apparatus for applying indicia (e.g., tax stamps) to objects (e.g., packages of cigarettes).

It is frequently necessary to apply indicia such as tax stamps to the outside of objects such as cigarette packages. Sometimes the objects have already been enclosed in outer packaging such as cigarette carton packaging. In that case, the outer packaging must first be opened, the indicia applied, and then the outer packaging reclosed. For example, a cigarette distributor may have the right to distribute cigarettes in two or more areas requiring different tax stamps. The cigarette manufacturer may ship the cigarettes to the distributor without the required stamps. The distributor must then apply the appropriate tax stamp to each cigarette pack prior to delivering the cigarettes to the area in which they will be consumed. Because the cigarettes are typically shipped to the distributor in cartons (e.g., of ten packs to the carton), the distributor must open each carton, apply the necessary tax stamps, and then reclose and seal the carton.

To further complicate the foregoing task, cigarette manufacturers from time to time produce or at least propose to produce cigarettes of different size (including cigarettes of different diameter), cigarette packs of different size (e.g., because the number or size of the cigarettes in the pack is different), and cigarette cartons in which the number and/or arrangement of the packs is different. This makes it extremely difficult to devise an automated way of applying tax stamps which is universally applicable to any possible combination of the foregoing variables.

Still another problem with the foregoing task is that the tax stamps to be applied generally have monetary value. It would therefore be highly desirable to facilitate protection of the stamps while they are not in use.

In view of the foregoing, it is an object of this invention to provide improved and simplified methods and apparatus for applying indicia such as tax stamps to objects such as cigarette packs.

It is a more particular object of this invention to provide tax stamp or other indicia applying methods and apparatus which are sufficiently flexible or adjustable to be readily adaptable to various indicia applying tasks.

It is still another object of this invention to provide indicia applying methods and apparatus in which the indicia supply is readily removable to facilitate resupply of the indicia when the methods and apparatus are in use, and protection or security of the indicia when not in use.

SUMMARY OF THE INVENTION

These and other obJects of the invention are accomplished in accordance with the principles of the invention by providing indicia applying methods and apparatus in which the indicia supply is contained within one or more removable cartridges. When the indicia applying methods and apparatus are not in use, the cartridges can be removed and stored in a safe and secure place to prevent them from being misappropriated or misused. In addition, the removable cartridge technique allows the apparatus of this invention to be quickly resupplied with indicia as the indicia are used up.

The indicia supply cartridges are disposed on a plurality of indicia applying heads which are movable along rails in the apparatus to allow the indicia to be applied with various spacings in various configurations and in various numbers. Accordingly, the apparatus can be readily set up to perform a wide range of indicia applying tasks.

In order to apply indicia to objects such as cigarette packages which are received in outer packaging such as cartons, the methods and apparatus of this invention include automatically opening the outer packaging to expose the objects, applying the indicia to the objects, and reclosing and sealing the outer packaging.

Further features of the invention, its nature and various advantages will be more apparent from the accompanying drawings and the following detailed description of the preferred embodiments.

BRIEF DESCRIPTION OF THE DRAWINGS

FIG. 5 is a partial sectional view taken generally along the line 5—5 in FIG. 2.

FIG. 6 shows one possible arrangement of indicia applied by the apparatus of FIG. 1.

FIG. 7 shows another possible arrangement of indicia applied by the apparatus of FIG. 1.

DETAILED DESCRIPTION OF THE PREFERRED EMBODIMENTS

Although the invention is applicable to applying other types of indicia to other kinds of objects, the invention will be fully understood from the following explanation of its application to applying tax stamps to cigarette packages.

Figure 1:
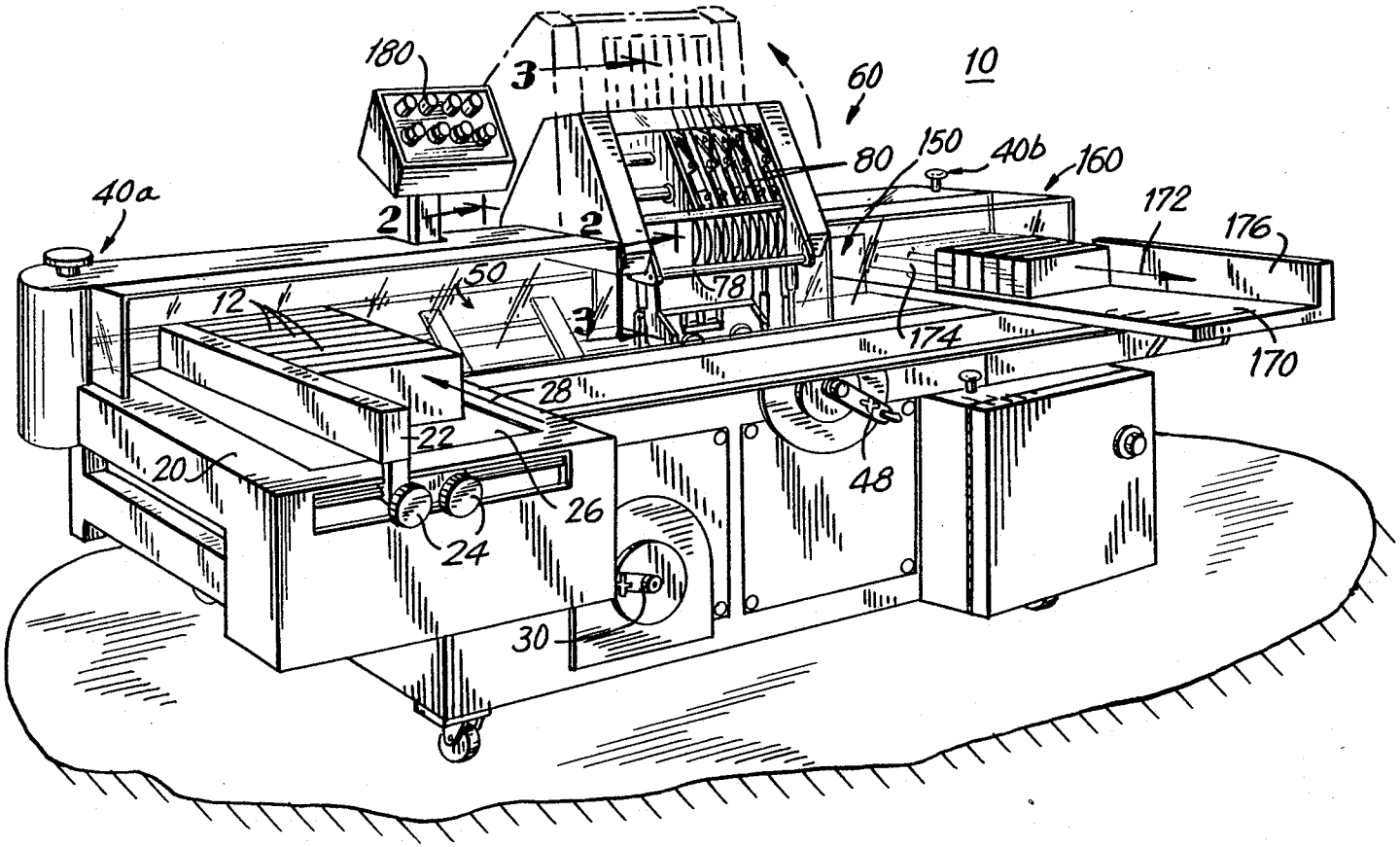
FIG. 1 is a perspective view of an illustrative embodiment of the apparatus of this invention.

As shown in FIG. 1, illustrative indicia applying apparatus 10 constructed in accordance with this invention includes an infeed table 20 on which cigarette cartons 12 are placed with one end against an adjustable reference edge 22. Reference edge 22 is movable perpendicular to the ends of cartons 12 to facilitate the processing of cartons of different lengths.

The upper surface of infeed table 20 includes conveyor belt 26 for conveying cartons 12 into the remainder of the machine in the direction indicated by arrow 28. The height of infeed table 20 (relative to the floor on which the machine rests) is adjustable by operation of crank 30 to allow the machine to accept cartons of different heights. (The height of track 42 and outfeed table 170, described below, is also controlled by crank 30 to be the same as the height of infeed table 20.)

Figure 2:
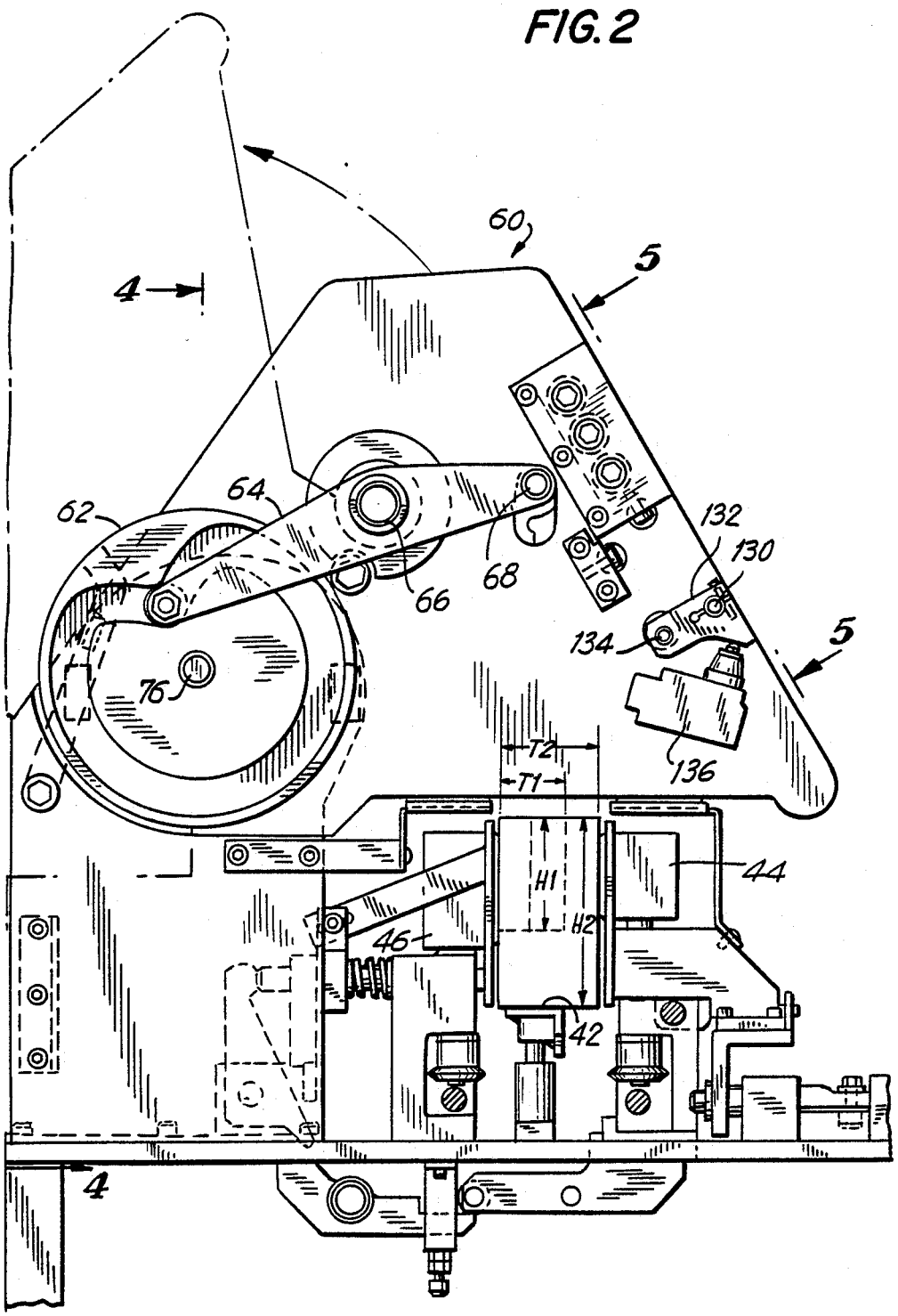
FIG. 2 is a partial sectional view taken along the line 2—2 in FIG. 1.

Inside the rear of the machine as viewed in FIG. 1, cartons 12 are conveyed one after another from left to right by chain and belt drive mechanisms extending between axle assemblies 40*a* and 40*b*. The chain, belt, and roller drive mechanisms (not shown in detail because straightforward) include upper and lower endless chains on which carton pushers are located at intervals at least as great as the length of the longest cartons to be processed. These carton pushers (and belts and rollers) propel each carton from left to right across the rear of the machine. The cartons are supported during this portion of their travel by track 42 (FIG. 2), which is stationary except for its ability to move up and down with infeed table 20 in response to operation of crank 30. The cartons are guided horizontally across the rear of the machine by being trapped between front and rear rollers 44 and 46 (FIG. 2). Front rollers 44 are movable toward or away from rear rollers 46 by operation of crank 48 (FIG. 1) to allow the apparatus to process cartons of different thickness or width (front to rear). In particular, FIG. 2 shows that the above-described adjustability of elements 42 and 44 allows the machine to process cartons having any height between dimensions H1 and H2, and any width or thickness between dimensions T1 and T2.

Figure 10:
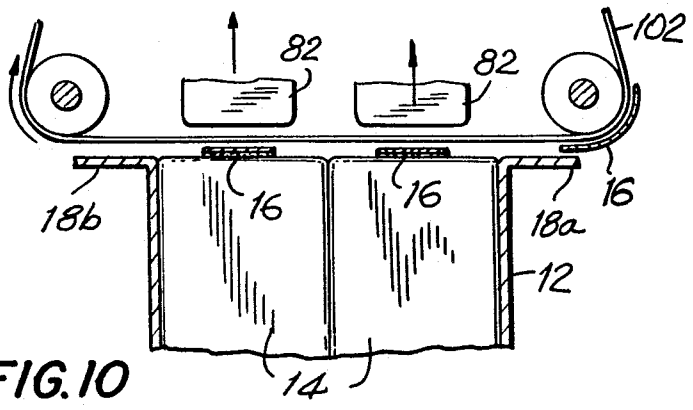
FIG. 10 shows a subsequent stage in the operating cycle of the apparatus shown in FIG. 9.
Figure 9:
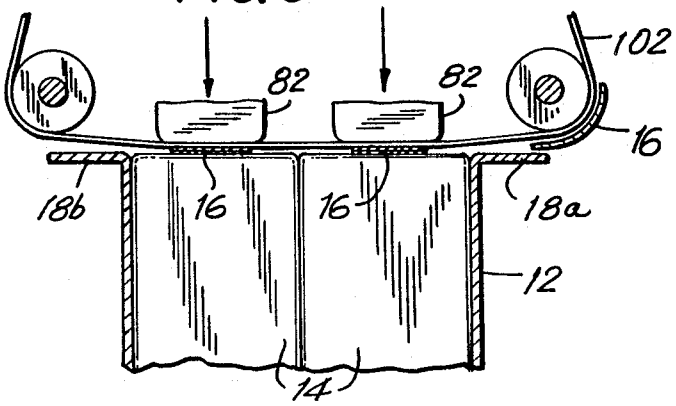
FIG. 9 is a partial sectional view showing the actual application of indicia in the apparatus of FIG. 1.

As each carton passes through an initial portion 50 of the rear of the machine, the top flaps 18*a* and 18*b* (FIGS. 9 and 10) of the carton are opened up by a stationary guide vane (not shown) and folded down so that those flaps are horizontal and respectively project forwardly and rearwardly from the carton. This exposes the tops of the cigarette packs 14 inside the carton.

When a carton which has been opened as described above is in position under indicia applying assembly 60 (as detected by a photosensor), the chain drive stops momentarily, thereby stopping the carton under assembly 60. Clutch 54 (FIG. 4) is then operated to cause motor 56 to produce one revolution of cam wheel 62 (see also FIG. 2). This in turn causes each of the operative indicia applying heads 80 in assembly 60 (e.g., FIG. 3) to apply an indicium 16 (e.g., FIGS. 6 and 7) to the top of a respective one of the packs 14 in the carton under assembly 60. In particular, revolution of cam 62 pivots rocker arm 64 about pivotal axis 66. This causes rod 68 to move down. Inside each of heads 80, rod 68 is connected to a ram 82 by a link 84 which is both pivotable about and slidable along rod 68, and which is also pivotally connected to ram 82 at pin 86. Assuming that head 80 is in use (i.e., that the associated switch 90 is on and that the head is loaded with a cartridge 100 containing an indicia supply tape 102), the lower end of ram 82 is heated by electrical current from wires 88. (There is one cartridge 100 on each head 80 which is in use. If a head is not in use, the associated switch 90 is thrown to cut off the supply of current to the ram 82 for that head, and the associated cartridge 100 is removed.) When ram 82 is driven down, the heated lower end of the ram presses the adjacent portion of indicia carrying tape 102 down against the top of a cigarette pack 14. The heat and pressure thus applied by ram 82 causes indicium 16 to transfer from tape 102 to the top of pack 14. After a suitable interval (established by the dwell time of cam wheel 62), ram 82 is raised again, but indicium 16 remains adhered to the top of pack 14.

Each time ram 82 reciprocates as described above, link 92 (which is pivotally connected to ram 82 at pin 94) rotates sprocket wheel 104 counterclockwise by an amount equal to the angular spacing between adjacent sprocket teeth 106. As ram 82 descends, link 92 travels down so that its lower end engages the next sprocket tooth 106. Sprocket wheel 104 is prevented from rotating clockwise by spring finger 108, and is also held in proper registration by stationary internal detent mechanism 110. Sprocket teeth 106 pass through holes in tape 102, which holes are located between adjacent indicia 16 on the tape. When ram 82 subsequently moves back up, link 92 causes sprocket wheel 104 to rotate counterclockwise by virtue of the engagement between the lower end of link 92 and a sprocket tooth 106. This advances tape 102 so that the next indicium 16 on tape 102 is below ram 82 for application to the top of a cigarette pack 14 in the next carton during the next operating cycle of the machine. Tape 102 (with indicia 16 thereon) is thereby gradually withdrawn from supply reel 112, and expended tape 102 is discharged from the rear of the machine as indicated by arrow 114 in FIG. 3.

After cam 62 has completed one revolution as described above, the cam stops and the chain drive resumes propelling the cartons across the rear of the machine. In the portion 150 (FIG. I) of the machine to the right of assembly 60 the top flaps 18 of the carton are glued and folded closed by stationary folding vanes (not shown). At the right-hand end 160 of the rear portion of the machine each closed carton is pushed forward off the chain drive by a reciprocating ram (not shown) which operates in synchronization with assembly 60. Accordingly, when the chain drive propelling the cartons across the rear of the machine stops for operation of head 60 as described above, the ram at the right-hand end 160 of the chain drive also operates to push the carton which is at the right-hand end of the chain drive forward out of engagement with the chain drive and onto outfeed table 170. Indeed, the above-described operation of the ram at the right-hand end of the chain drive pushes all of the cartons on outfeed table 170 forward as indicated by arrow 172. Spring finger 174 urges the cartons on outfeed table 170 to the right against reference surface 176. 0n the initial portion of outfeed table 170 (nearest the above-mentioned chain drive) the cartons pass under a stationary bridge which holds down the top flaps 18 of the carton in order to ensure that the previously applied glue seals those flaps closed. Like track 42, outfeed table 170 moves up and down with infeed table 20 (under the control of crank 30) to enable the apparatus to process cartons of different heights (HI to H2 in FIG. 2).

Various control switches (e.g., on, off, emergency stop, etc.) are provided on control panel 180.

Figure 8:
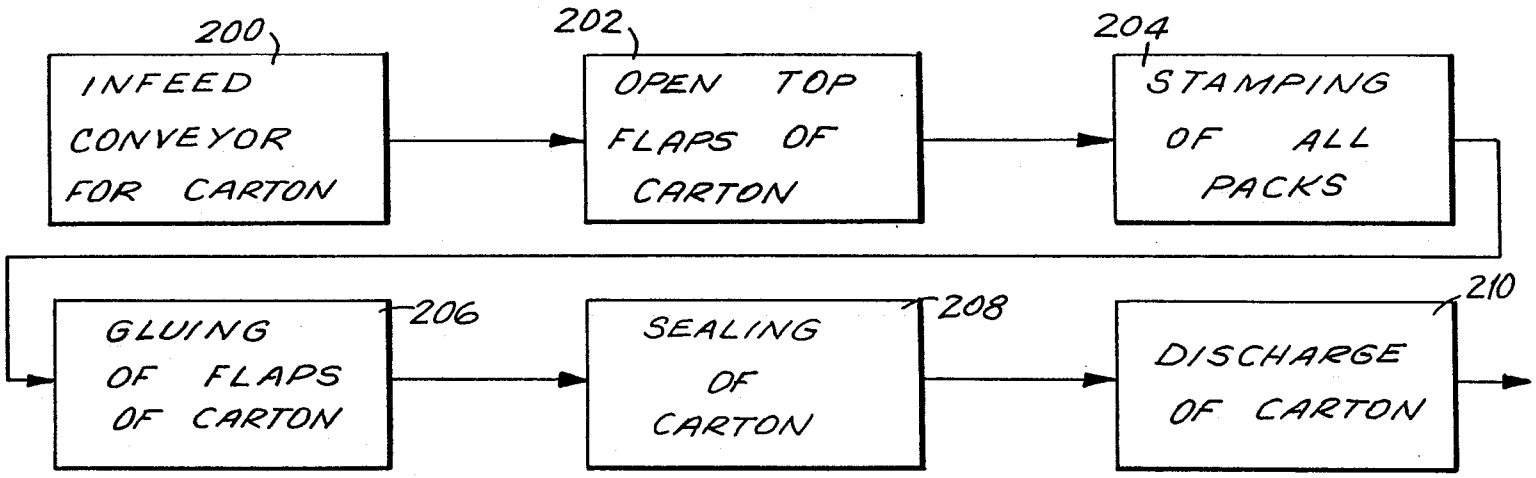
FIG. 8 is a flow chart of an illustrative embodiment of the method of this invention.

An overall flow chart of the manner in which the apparatus of the other FIGS. processes a cigarette carton is shown in FIG. 8. In step 200 the carton is fed into the machine (e.g., on infeed conveyor 26). In step 202 (e.g., in machine region 50) the top flaps 18 of the carton are opened and folded back to the positions shown in FIGS. 9 and 10. In step 204 (e.g., under assembly 60) indicia 16 are applied to all of the packs in the carton. In step 206 (e.g., in region 150 of the machine) glue is applied to the top flaps 18 of the carton. In step 208 (e.g., in regions 150 and 160 of the machine) the top flaps 18 are closed and sealed. And in step 210 the carton is discharged from the machine (e.g., via outfeed table 210).

Heads 80 are movable horizontally across assembly 60 as indicated, for example, by the arrows 70 in FIGS.

4 and 11. This makes it possible for the machine to stamp packs of different sizes and/or arrangements in the carton. In addition, adjacent heads 80 apply their stamps at locations which are staggered or offset from one another in the direction from front to rear of the machine. This is apparent, for example, in FIG. 11. The staggering of adjacent stamp sites also facilitates use of the machine to process various pack sizes and arrangements. For example, FIG. 6 shows how the machine can be set up to apply indicia 16 to packs in a carton in which all the packs are lined up front to back, while FIG. 7 shows how the machine can be set up to apply indicia 16 to packs in a carton in which the packs are arranged in two parallel rows. In both of these FIGS. the dotted lines 80 indicate the locations of adjacent heads 80. In FIG. 6 heads 80 are relatively close together, while in FIG. 7 heads 80 are moved farther apart.

Heads 80 are slidably mounted on rods 72 which extend horizontally from side to side in assembly 60. The horizontal location of each head 80 is fixed by an associated latch 96 (FIG. 3) which is manually pivotable about pin 98 and which is otherwise urged into contact with bar 74*a* by spring 220. If desired, latches 96 may engage teeth on bar 74*a* in order to positively hold each head 80 in the desired horizontal location. Electrical power (for heating the lower end of ram 82) is applied to each head 80 via horizontally extending bars 74*a* and 74*b*. Carbon brush 222 slidably engages bar 74b to provide one contact, while the other contact is provided by latch 96 engaging bar 74*a*. A lead (not shown) runs from latch 96 to one terminal of switch 90. One of leads 88 runs from the other terminal of switch 90 to the heater on ram 82, while the other lead 88 runs from the heater to carbon brush 222.

Figure 11:
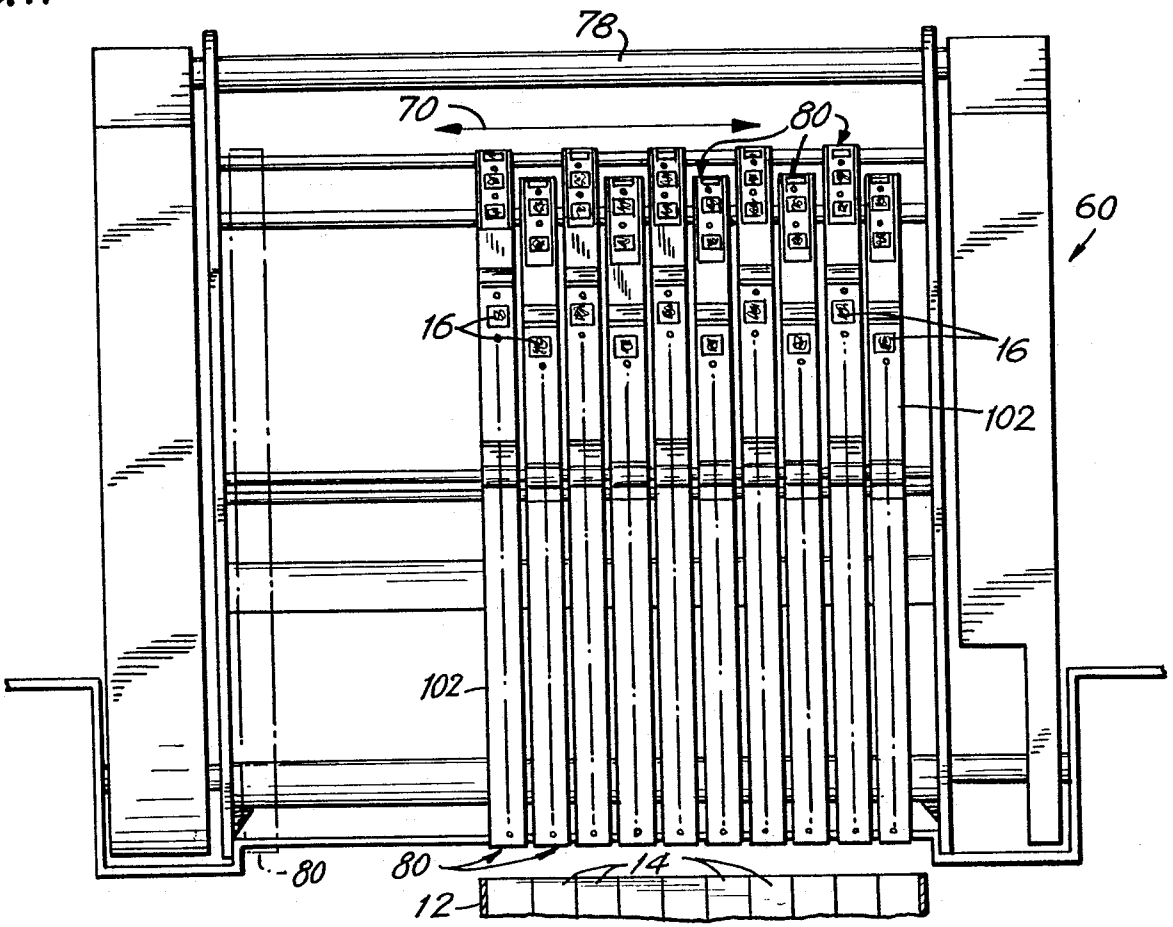
FIG. 11 is an elevational view of a portion of the apparatus of FIG. 1 with the indicia applying assembly pivoted up to allow removal or replacement of indicia supply cartridges and/or lateral relocation of the individual indicia applying heads.

Assembly 60 is manually pivotable up and to the rear about pivotal axis 76 as shown in broken lines in FIGS. 1 and 2. Bar 78 is provided as a handle for pivoting assembly 60 in this manner. Note that axis 76 is also the axis of rotation of cam wheel 62. FIG. 11 shows the underside of assembly 60 when that assembly is pivoted up.

When assembly 60 is pivoted up as described above, the tail 232 (FIG. 3) of pivotable member 230 in each of heads 80 hits a stationary part (not shown) of the machine. This causes pivotable member 230 to pivot counterclockwise about pin 234, i.e., out of the normal position established by prestressed tension coil spring 236. This disengages member 230 from pin 116, and also pivots link 92 counterclockwise out of engagement with sprocket wheel 104. With pin 116 and sprocket wheel 104 thus disengaged, each cartridge 100 (including all elements numbered 102–122) can be completely removed from the machine. Finger grips 122*a* and 122*b* are provided on each cartridge to facilitate cartridge removal in this way. Because cartridges 100 are thus easily removable from the machine, and also because they are relatively small, the cartridges (containing valuable indicia 16) can be readily removed from the machine and stored in a safe place whenever the machine is not in operation.

With a cartridge 100 out of the machine as described above, the indicia supply reel 112 can also be replenished. This is accomplished by pivoting cartridge cover 118 (FIG. 3) counterclockwise about pin 120. This allows an expended supply reel 112 to be removed and a new reel to be put in. The leading portion of the new supply reel tape 102 is then threaded through the cartridge along the path shown in FIG. 3, after which the cartridge can be remounted on the machine. Note that as soon as assembly 60 is pivoted down from the dotted line position shown in FIGS. 1 and 2, spring 236 restores member 230 to the position shown in FIG. 3, thereby locking cartridge 100 to assembly 60.

Assembly 60 may include more heads 80 than are needed in all cases. Any heads 80 which are not needed for a particular carton processing run are typically shifted to the extreme left-hand side of assembly 60, the associated cartridges 100 are removed, and the associated rams 82 are left unheated by turning off their switches 90.

Figure 3:
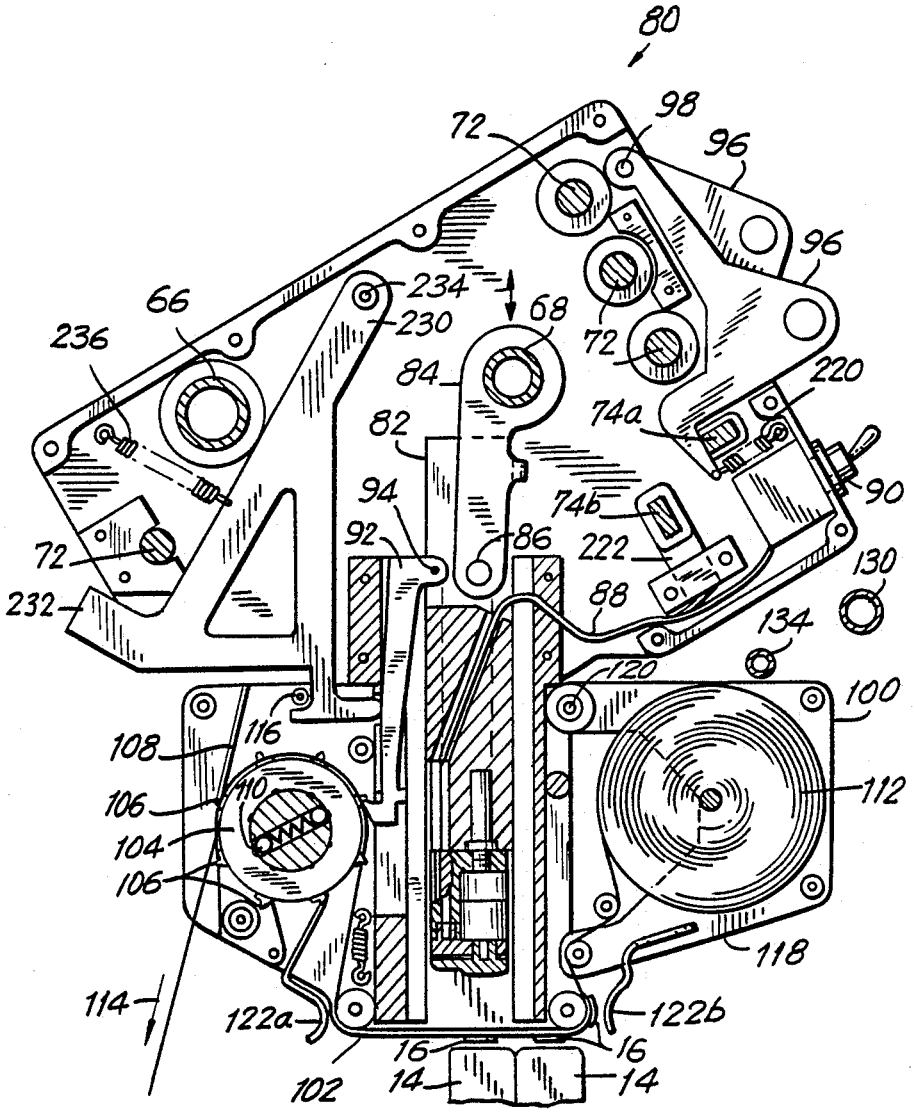
FIG. 3 is a partial sectional view taken along the line 3—3 in FIG. 1.
Figure 4:
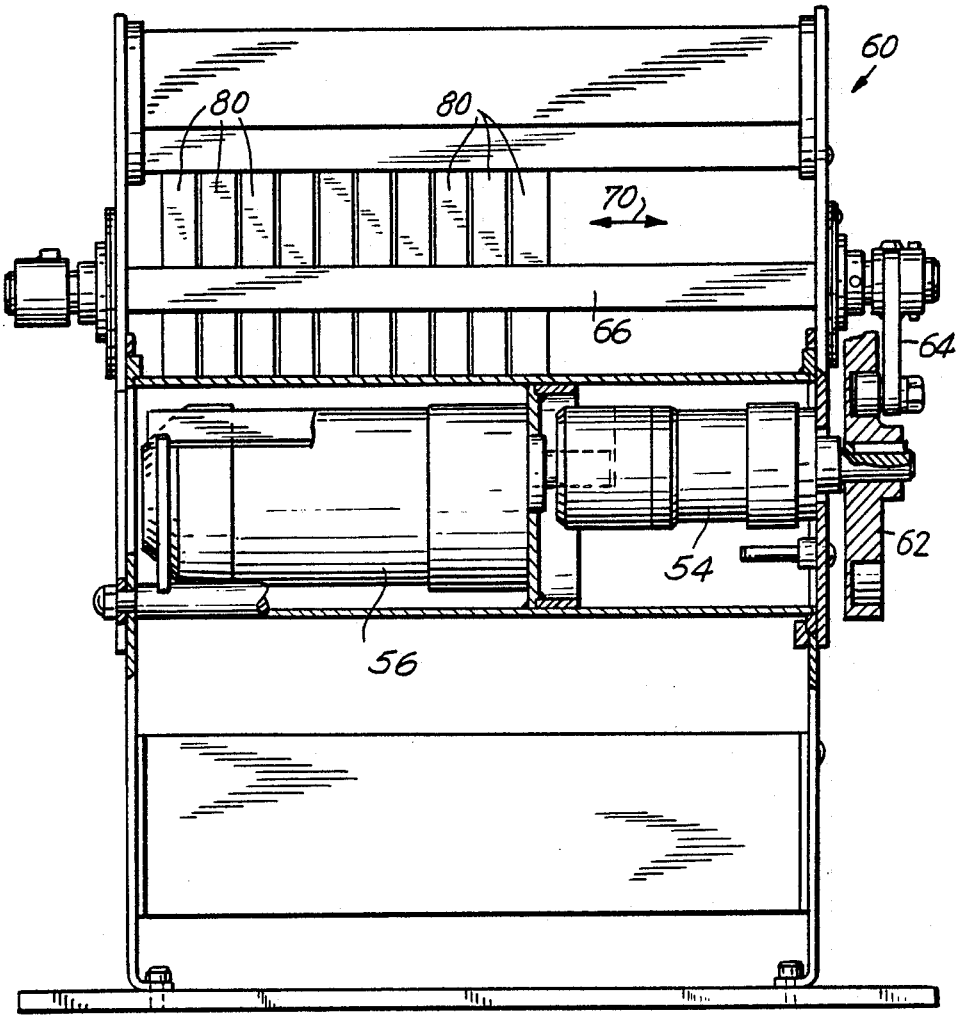
FIG. 4 is a partial sectional view taken along the line 4—4 in FIG. 2.

Indicia applying assembly 60 includes elements (best seen in FIGS. 2, 3, and 5) for preventing the machine from operating after the last indicium 16 in any cartridge 100 has been used. Rod 130 is rotatably mounted in assembly 60. Bracket 132 is fixedly mounted on rod 130 for rotation with the rod. Rod 134 is mounted near one end of bracket 132 and (as shown in FIG. 3) contacts a surface of each cartridge 100 present in the machine. The other leg of bracket 132 contacts the actuator of switch 136 which is also mounted on assembly 60. A spring (not shown) urges rod 130 adn bracket 132 to pivot counter-clockwise as viewed in FIGS. 2 and 3. When the last indicium 16 in any cartridge 100 has been used, the end fo the tape 102 in that cartridge forces part of the cartridge to rotate counter-clockwise about pivot 120 as viewed in FIG. 3. This lifts rod 134, which causes rod 130 to rotate clockwise as viewed in FIG. 3, thereby actuating switch 136 via bracket 132 and preventing the machine from operating.

We claim:

1. Apparatus for simultaneously applying a tax stamp to the top of each of a plurality of cigarette packs which are packed in a carton in a predetermined array with the tops of all of the packs side by side in a common plane comprising:

a support structure;

a plurality of substantially separate tax stamp applying heads, each of which is intended for applying a tax stamp to the top of an associated respective one of said packs;

means for mounting each of said heads on siad support structure so that each head can be moved relative to the other heads in order to position each head for applying a tax stamp to the top of the associated pack, said means for mounting including means for releasably securing each of said heads in position on said support structure after said head has been positioned for applying a tax stamp to the top of the associated pack; and means for moving said carton relative to said support structure so that said carton is momentarily stopped with the top of each of said packs adjacent the associated head; each of said heads including:

a tax stamp supply member having a plurality of tax stamps removably disposed thereon;

means for positioning a portion of said supply member containing a tax stamp adjacent the top of the associated pack; and means for pressing said portion of said supply member against the top of the associated pack while said carton is momentarily stopped with the top of each of said packs adjacent the associated head to cause said tax stamp to transfer from said portion of said supply member to the top of the associated pack.

2. The apparatus defined in claim 1 wherein each of said heads further includes:

means for heating said portion of said supply member to facilitate transfer of said tax stamp from said supply member to the top of the associated pack and adherence of said tax stamp to said pack.

3. The apparatus defined in claim 2 wherein the supply member associated with each of said heads is contained in a cartridge, and wherein each of said heads further comprises:

means for removably securing a cartridge to said head.

4. The apparatus defined in claim 1 wherein said supply member is an elongated tape having saod tax stamps spaced along the length of said tape, and wherein said means for positioning comprises:

means for advancing the tape lenght-wise by an amount substantially equal to the spacing of said tax stamps on said tape after each application of a tax stamp from said tape.

5. The apparatus defined in claim 1 further comprising:

means for monitoring the usage of the supply member in each of said heads; and means for preventing further operation of said apparatus when said means for monitoring indicates that the supply member in any of said heads is exhausted.

6. The apparatus defined in claim 1 wherein said carton is initially closed, and wherein said means for moving said carton comprises:

means for opeing said carton in order to expose the tops of said packs for application of said tax stamps; and means for closing said carton after sid tax stamps have been applied.

7. The apparatus defined in claim 6 wherein said means for closing said carton includes:

means for sealing said carton closed.

* * * * *